United States Patent [19]

Dunden

[11] Patent Number: 4,711,356

[45] Date of Patent: Dec. 8, 1987

[54] CONTAINER FOR FREEZING AND STORAGE OF FOODSTUFFS

[75] Inventor: Walter J. Dunden, Eugene, Oreg.

[73] Assignee: Chef Francisco, Inc., Eugene, Oreg.

[21] Appl. No.: 201,908

[22] Filed: Oct. 29, 1980

[51] Int. Cl.[4] ..... B65D 21/02

[52] U.S. Cl. ..... 206/503; 206/422; 206/443; 206/509; 206/518; 220/236

[58] Field of Search ..... 206/422, 443, 518, 503, 206/504, 509, 511, 512; 220/23.8, 23.6, 70; 215/10

[56] References Cited

U.S. PATENT DOCUMENTS

| | | | |
|---|---|---|---|
| 2,123,215 | 7/1938 | Thomas . | |
| 2,984,346 | 5/1961 | Holley . | |
| 3,121,492 | 2/1964 | DePaul | 220/443 |
| 3,154,215 | 10/1964 | Vesconte | 206/518 |
| 3,200,943 | 8/1965 | Waterbury . | |
| 3,220,856 | 11/1965 | Vischer . | |
| 3,272,371 | 9/1966 | Weiner . | |
| 3,322,267 | 5/1967 | Weiss | 220/23.6 |
| 3,523,608 | 8/1970 | Miller | 206/518 |
| 3,615,039 | 10/1971 | Ward | 206/518 |
| 3,759,416 | 9/1973 | Constantine | 220/70 |
| 3,933,268 | 1/1976 | Buske | 215/10 |

FOREIGN PATENT DOCUMENTS

| | | | |
|---|---|---|---|
| 2364259 | 6/1975 | Fed. Rep. of Germany | 206/503 |
| 2626952 | 12/1977 | Fed. Rep. of Germany | 206/509 |
| 598186 | 9/1959 | Italy | 206/422 |

*Primary Examiner*—George E. Lowrance

*Attorney, Agent, or Firm*—Fisher, Christen & Sabol

[57] ABSTRACT

A container for the freezing and compact storage of foodstuffs prepared in large batches is provided with a rectangular open top with two or more transverse pockets in the bottom to provide maximum exposure of the contents to a cooling medium. The spaces between the pockets are greater than the size of the pockets themselves and a space is reserved at one end of the bottom so that when frozen one container may be inverted and also turned end-for-end to enable another container to be stacked upon it in upright position overall vertical alignment. Portions of the side walls are spatially offset so that the line of demarcation between the two wall areas provide for expansion of the walls as a whole to resist "doming" of the frozen contents.

22 Claims, 5 Drawing Figures

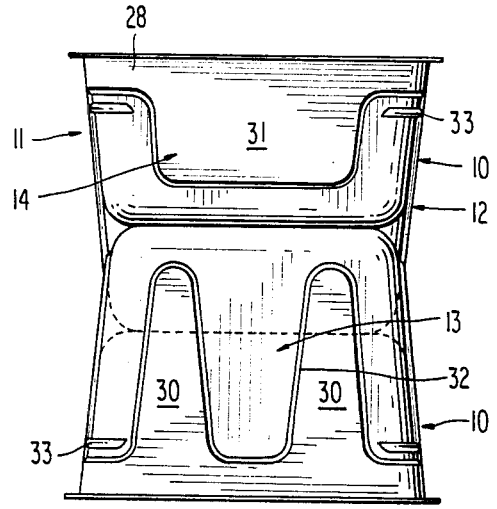
FIG. 3
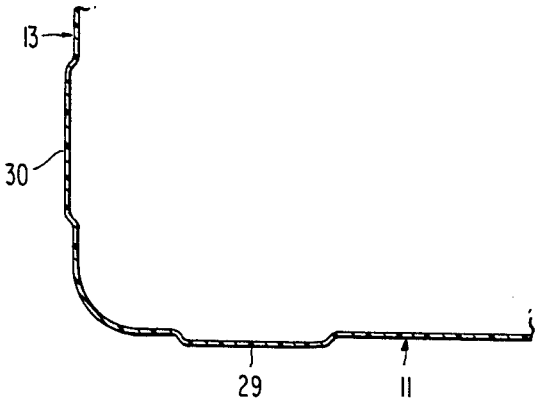
FIG. 4a
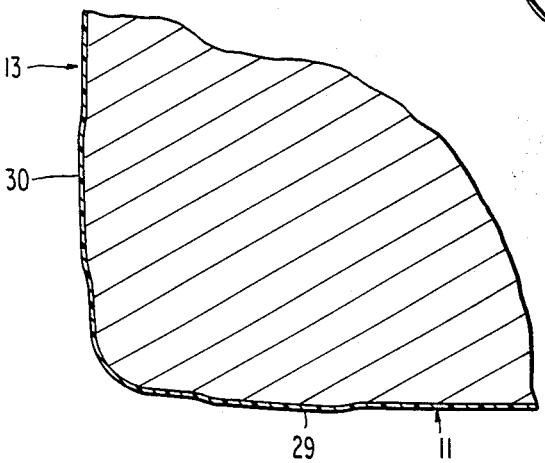
FIG. 4b
FIG. 5
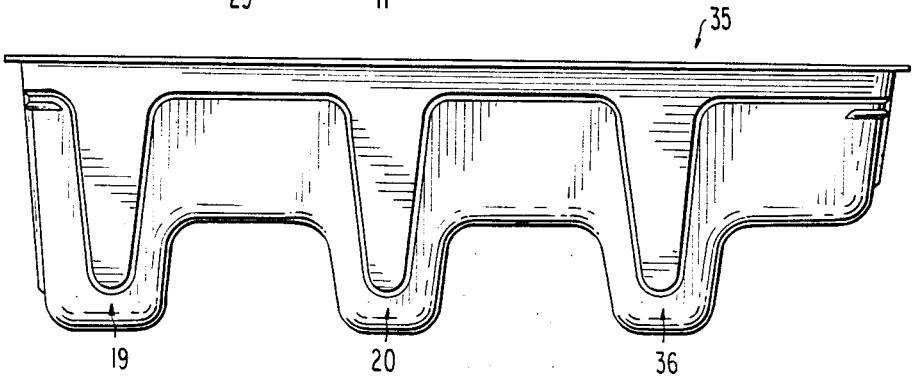

CONTAINER FOR FREEZING AND STORAGE OF FOODSTUFFS

BACKGROUND OF THE INVENTION

This invention relates to containers of the type used in the freezing and subsequent storage of foodstuffs, particularly those which are substantially fluids of very low viscosity, such as juice or consomme, or of higher viscosity, for example, certain soups, soup concentrate or stew. More specifically, the invention pertains to such containers for use especially in large-scale food operations.

DESCRIPTION OF THE PRIOR ART

In the industrial preparation of frozen foodstuffs of the above-mentioned type for institutional use, such as in hotels, hospitals, cafeterias and the like, the appearance of the containers therefore is umimportant since they are generally not seen by the ultimate consumer of the foodstuffs. As a consequence, such containers tend to be economically mass-produced using the cheapest materials that fullfil the most basic of requirements and are usually of a size and shape to allow their use for the freezing and subsequent storage of a variety of such foodstuffs. However, the tendency to make such containers as economical and versatile as possible results in certain inherent disadvantages.

One type of container used extensively for such purposes is simply a plastic bag. On filling and sealing such bags with the selected foodstuff, a certain amount of space must be provided within the bag to allow for the expansion of the foodstuff on freezing. Prior to freezing such filled and sealed bags are very inconvenient to handle due to their flexibility and the fluid nature of their contents, the movement of which is somewhat enhanced by the above-stated space. Once frozen, such bags are very difficult to handle and store because of their slipperiness and the irregular shapes adopted by the contents on freezing. On handling such frozen bags, they are not infrequently ruptured or ripped and a loss of product is incurred. In view of the above, it is impossible to satisfactorily stack such frozen bags in refrigerated storage areas or compartments. In an effort to minimize those problems, it is customary to place the bags into boxes prior to the freezing process. While the handling and stacking problems of the frozen bags may thus be reduced, the time required to freeze the foodstuffs contained therein is increased dramatically. For example, three bags of 0.5 gallon capacity containing soup concentrate placed in a box require approximately 4-5 days to freeze to a satisfactory degree, as opposed to a matter of hours to freeze them individually, in a conventional cooling tunnel-type freezer.

A still further disadvantage encountered in using such bags is that the rate of freezing is not uniform throughout the mass of the foodstuff. It is known that, generally, the size of ice crystals is inversely proportional to the rate of freezing. Consequently, if the rate of freezing is too slow, either throughout the entire mass or portions of the foodstuff, ice crystals are formed sufficiently large enough to rupture the individual cell structure of meat or vegetable matter in the foodstuff. Such cellular disruption results in undesirable changes in the organoleptic properties of the affected foodstuff, such as altered mouthfeel, colour, texture and flavour. Additionally, in such areas of the foodstuff where the rate of freezing is too slow, excessively high detrimental microbial growth may occur in foodstuffs not previously treated or capable of being treated with sufficiently high temperatures of chemical preservatives to inhibit such growth.

A further type of container commonly employed in the preparation of such frozen foodstuffs is a rectangular, rigid-walled typed of pan. To allow the ready transfer of heat, such containers are generally constructed of aluminum. One of the major problems encountered with such rigid-walled containers is the occurrence of "doming" exhibited by the frozen contents. This is the phenomenon that may be observed, for example, in the formation of ice cubes in a household refrigerator and results from the fact that the rigid walls and bottom of the ice cube mold force the expanding, freezing water upward in the centre as the influence of the cooling proceeds inwardly from the sides and bottom of the mold.

Such doming can distend and sometimes even burst the lid of such containers exposing the frozen contents resulting not only in possible loss of product but also adulteration thereof. Distention of the lid by doming also makes stacking of such containers impractical if not impossible. Attempts to overcome the problem by "low filling" the containers results in an obvious waste of space and material which is reflected in an increased cost per unit of foodstuff frozen, transported or stored in such containers.

STATEMENT OF THE INVENTION

Therefore, it is an object of the present invention to provide a new and improved container for freezing and subsequently storing fluid foodstuffs.

It is a further object of the invention to provide such a container which allows a substantially uniform rate of freezing throughout the mass of the foodstuff.

Another object of the invention is to provide such a container which substantially eliminates occurrence of the "doming" on freezing the foodstuff container therein.

Yet a further object of the invention is to provide such a container, which is adapted so that a plurality of thereof, containing frozen foodstuff, may be stacked in a manner to allow substantially maximum use of space during transport or storage.

Still a further advantage is to provide such a container which is adapted to achieve a high bulk density of its frozen contents to facilitate the handling thereof.

The above and further advantages are realized in accordance with the present invention by providing an open-topped, generally rectangular container of extensible, sheet plastic, which is provided with at least two depending transverse, substantially parallel pockets adapted to maximize the surface area relative to the volume and, consequently, maximize exposure of the foodstuff contained therein to the cooling fluid, usually air, used in the freezing process. For the purposes of this specification the term "rectangular" is defined as a shape having four sides and four right angles and includes, therefore, a square shape.

In addition, these pockets, spaced from each other by a distance in excess of the maximum width of such a pocket, permit the containers, after freezing the contents, to be stacked compactly one upon another in layers, with alternate layers inverted and reversed. So stacked, the margins of the respective tops of the superposed containers are in substantial vertical alignment with each other. The compact nature of the stacked containers minimizes the volume of space required to transport or store them and maximizes the bulk density.

The plastic material of which these containers are constructed is of a type which is economical, easily molded and readily extended by the expansive force of the freezing foodstuff. Consequently, the thickness of the material should be as thin as practically possible to maximize the desired rapid rate of heat transfer and allow for the extensibility of the material. The man skilled in the art will be able to determine suitable plastic materials without undue difficulty. A material which fulfils the above-stated prerequisite conditions very satisfactorily has been found to be high density polyethylene. On the other hand, it has been found further that polystyrene is generally unsuitable in that it is prone to cracking and rupturing either as the foodstuff expands on freezing or on subsequent handling of the container and frozen contents.

In view of the above, it will become evident that the spaces between the pockets not only permit continuous circulation of the cooling fluid substantially around the pockets of such filled and frozen, stacked containers, but also allow extension of the pockets as the contents freeze.

To allow the plastic to be as thin as possible for the above-mentioned reasons, it is preferred that certain areas of the walls, conveniently termed expansion ribs, be outwardly, spatially offset and joined to the adjacent wall areas by junction lines which in cross-section resemble a S- or reversed S- curve. These areas and junction lines serve to provide strength and rigidity to the desirably thin walls. They further serve to allow the expansive forces which act on the walls during the freezing of the contents to distend the walls by distorting or flattening the shape of the junction lines. This, in conjunction with the extensibility of the plastic material, ensures that "doming" of the freezing foodstuff is substantially eliminated.

As a result, the containers of the present invention may be filled substantially full since, when frozen, the upper surface of the foodstuff will generally be flat. This not only substantially eliminates waste of material and space, but also enables such filled containers to accommodate simple, inexpensive lids, for example, a lid of sheet plastic material bonded to the upper margins, comprising outwardly turned lips or flanges, of the container without fear that it will burst or rupture as a result of "doming" (preferably, lids are affixed prior to freezing to prevent spillage). Additionally, the resulting flat tops of the containers ensure stability of the containers when stacked. The type or construction of the lid is not critical to the success of the present invention providing it is sufficiently flat to allow proper stacking of the containers and frozen contents.

The container of the present invention provides for a substantial increase in bulk density of the packaged frozen contents thereby greatly facilitating the handling of larger volumes of the foodstuff. At the same time, the present container allows the contents to be frozen at a very rapid and uniform rate throughout the mass of the foodstuff. As a result, not only is the overall preparative time of the packaged, frozen foodstuff significantly reduced, but the quality of contents is much improved since the size of the ice crystals formed during freezing is small and cellular disruption of meat or vegetable matter is substantially prevented. In addition, such small ice crystal size minimizes the disruption of the cross-linking the gel structure of any thickening agent, e.g. hydrated starch, present in the foodstuff. Further, the rapid, uniform rate of freezing also functions to inhibit undesirable microbial growth in the foodstuff during the freezing procedure.

Exemplary of the freezing speed achieved by the use of the present containers is that such containers made of high density polyrethylene, having a capacity of approximately 0.5 gallons and containing soup concentrate, require merely 1–1.5 hours to freeze the contents to the desired extent.

DETAILED STATEMENT OF THE INVENTION

Further objects and advantages and a better understanding of the present invention may be had by reference to the following detailed description taken in conjunction with the accompanying drawings, wherein:

FIG. 3 is an end elevation of the stacked containers as viewed from the right side in FIG. 2;

FIG. 4A is a fragmentary cross-section on the line 4A—4A of FIG. 2;

FIG. 4B is a schematic representation of the fragmentary cross-section illustrated in FIG. 4A altered to show the effect of the expansive forces of the freezing foodstuff on junction lines; and FIG. 5 is a perspective view of a modified form of the preferred embodiment having three transverse pockets.

Figure 1:
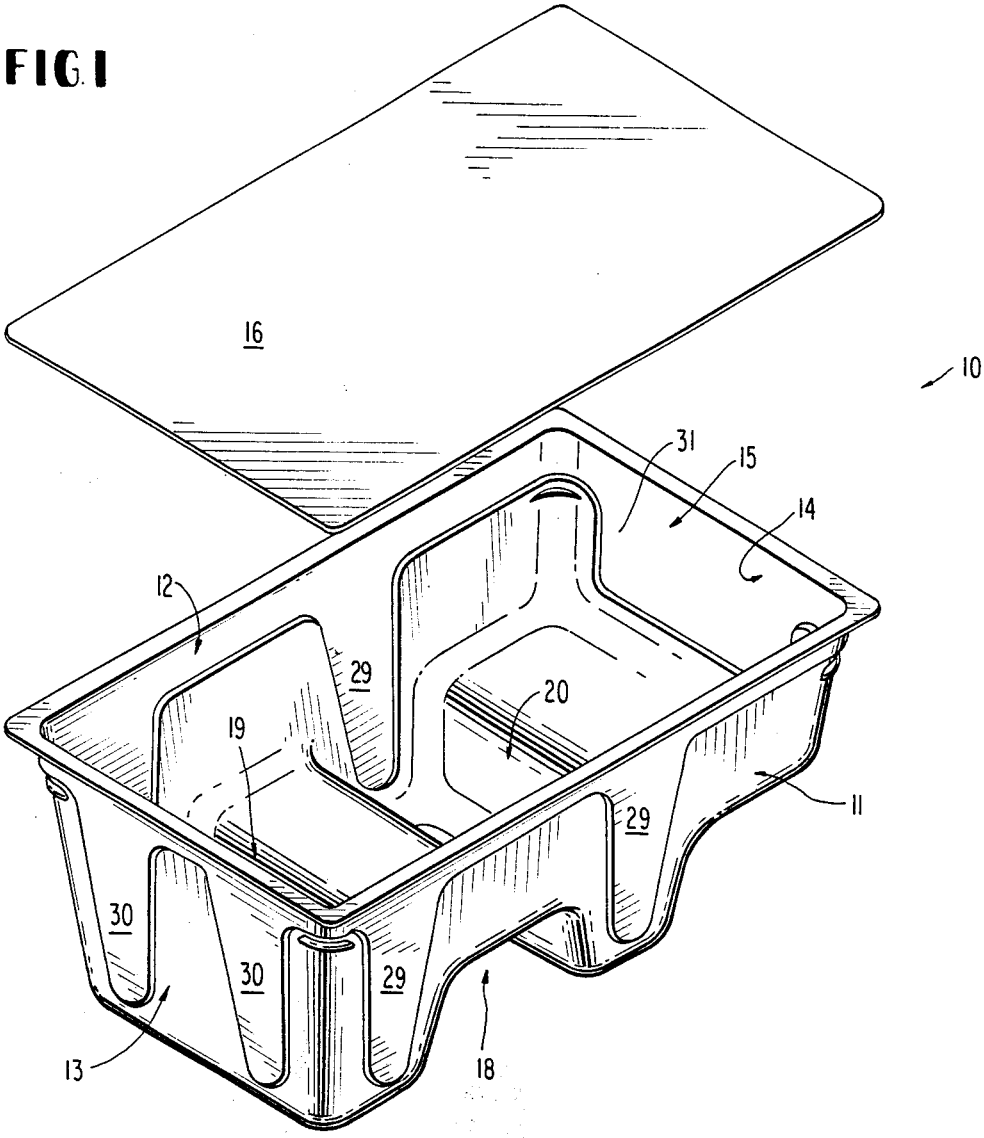
FIG. 1 is a perspective view of a preferred form of the container for freezing and storing fluid foodstuffs constructed in accordance with the present invention.
Figure 2:
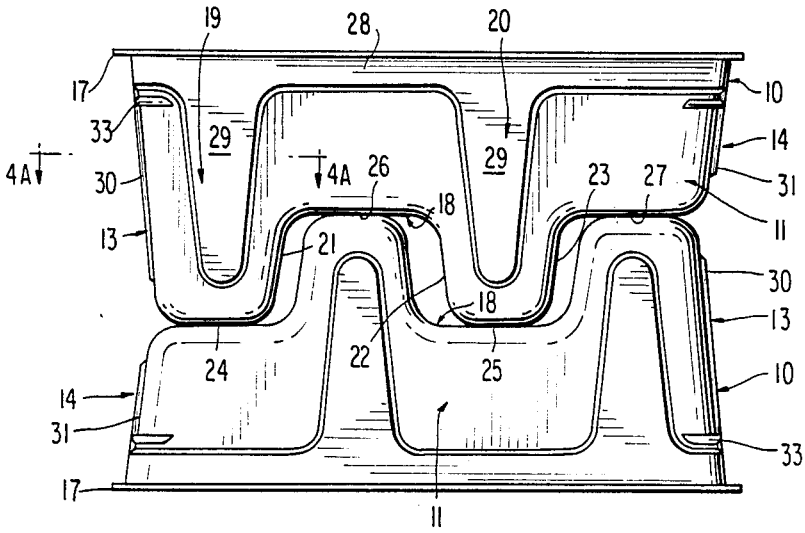
FIG. 2 is a side elevation of two identical containers of the type depicted in FIG. 1, stacked in superposed relationship for transport or storage.

In the drawings, the preferred embodiment of the present containers for freezing and storage of fluid foodstuffs is indicated generally by numeral 10 and is molded from a single sheet of a plastic material such as polyethylene or a similar suitable material by any well known process, such as vacuum forming, to provide a pair of generally parallel side walls indicated generally by numerals 11 and 12, having a slightly downwardly and inwardly converging relationship, joined by respective substantially parallel end walls, indicated generally by numerals 13 and 14 and also having a slightly downwardly and inwardly converging relationships. The depth of one end wall 13 is substantially greater than the depth of the other end wall 14, this relationship in one example as actually produced being on the order of two to one. The upper margins of the side and end walls terminate at a common horizontal level to define a substantially rectangular open top, indicated generally by numeral 15, which can be closed by a rectangular sheet 16 of plastic material. For this purpose, the top edges of the side and end walls are provided with an outwardly turned lip 17 which can be bonded to the lid 16 by heat sealing or by the use of an adhesive.

The lower margins of the side walls 11 and 12 are defined by a bottom indicated generally by numeral 18 which extends in a corrugated path from the lower margin of the deep end wall 13 to the lower margin of the short end wall 14 having a uniform configuration in a transverse direction from side wall 11 to side wall 12. This configuration provides two downwardly depending transverse pockets 19 and 20 having downwardly converging walls in a lengthwise direction defined, in the case of pocket 19 by the end wall 13 and the upwardly sloping area 21 of the bottom, and in the case of pocket 20 by the upwardly sloping areas 22 and 23 of the bottom. The lower extremities, or apicies of the pockets are defined by the respective areas 24 and 25 of the bottom wall. These areas shown in the drawing as being substantially flattened, but they could have an arcuate configuration in the transverse direction provided the distance from the top is the same for both apicies in order to provide a level opening when supported on a horizontal surface when the container is being filled.

The generally horizontal areas 26 and 27 of the bottom extending respectfully between the sloping areas 21 and 22 and the sloping area 23 and the lower extremity of the short end wall 14, are disposed at the same depth from the open top of the container to form ledges for a purpose which will be explained below.

As stated hereinbefore, allowance is made in the present invention for the expansion of the contents during freezing by providing for lateral expansion of the contents, so that containers may be substantially full to provide essentially flat upper surfaces which permit their stacking several layers deep.

For this purpose, and also to provide additional dimensional stability of horizontal rib 28 extends around the entire periphery of the upper margins of side walls 11 and 12 and end walls 13 and 14 and is formed by slightly spatially outwardly offsetting and sheet material in that region of the container. In addition, the spatially outwardly offset area is preferably extended downwardly at certain spaced locations around the walls of the container as, for example, in the areas 29 of the side walls defining the pockets 19 and 20. A pair of similar expansion areas or ribs 30 may also be provided in the deep end wall 13 while a single wide expansion rib 31 may be sufficient for the short end wall 14. In this connection, it should be noted that the effectiveness of the various expansion ribs does not lie simply in the extensibility of the sheet material itself, but results also from the fact that all along the junction between the spatially offset areas and the remaining areas of sheet material, as defined by the line 32, the material in cross-section follows a S- or a reversed S- curve configuration which, when stressed in a planar direction, causes the junction to assume a distorted, flattened configuration.

Due to the fact that all of the opposing interior wall surfaces are disposed in a downwardly convergent relationship to each other, the containers may be nested on within another so as to conserve a considerable amount of space when stored or shipped, when empty. However, it is preferable to form outwardly projecting detents, such as the horizontal beads 33 located at the four corners, to limit the extent to which each container can be inserted into another during nesting and thereby facilitating the rapid separation of the nested containers when required.

A modified form of the preferred embodiment of the invention is shown in FIG. 5, as indicated generally by numeral 35. This modification differs only in that the number of transverse pockets has been increased to three, the additional pocket being indicated by numeral 36. The number of pockets may be increased without changing the overall length of the container but, generally speaking, additional pockets would only be used to increase the capacity of the container, with a concomitant increase in its overall length. In other respects, the details of the modified form remain the same.

I claim:

1. An article for use in the packaging, freezing and storing of fluid foodstuffs comprising:

an open-topped elongated rectangular container molded of extensible sheet plastic material to be closed by a substantially rectangular lid;

said container having a body defined by generally parallel, slightly downwardly convergent side walls and generally parallel, slightly downwardly convergent end walls, the depth of one end wall being substantially greater than the depth of the other end wall;

and a corrugated bottom joined with the side walls and end walls and defining with the side walls and said one end wall at least two downwardly depending transverse substantially parallel pockets of equal depth spaced from each other and from said other end wall and having downwardly convergent walls;

said bottom defining with the side walls and said other end wall at least two generally horizontal transverse ledges spaced from each other and disposed in the same horizontal plane, one of the ledges being disposed between a pair of said pockets;

whereby when empty, a plurality of said containers may be nested in one another, and when filled, one container may be inverted and reversed end for end so that a second similar filled container may be superposed thereupon with a ledge of the second container supported upon the apex of an upwardly projecting pocket of said one container and with the margins of the respective tops in vertical alignment with each other;

the plastic being of a type which is extensible in response to the expansive force of the foodstuff during the freezing process and of a thickness sufficient to allow rapid transfer of heat and extensibility;

the space between a pair of said pockets exceeding the space occupied by an interfitting pocket of a superposed package sufficient to allow for the expansion of the pockets during the freezing of the contents and to permit the circulation of cooling fluid during transport or storage.

2. An article defined in claim 1, wherein the length to width ratio of the top is approximately two to one.

3. An article defined in claim 1, wherein the upper margins of the walls terminate in an outwardly turned lip, whereby a lid of sheet plastic material may be bonded thereto to form a hermetic seal.

4. An article defined in claim 1, wherein at least two pockets and two ledges are provided.

5. An article defined in claim 1, wherein at least three pockets and three ledges are provided.

6. An article defined in any one of claims 1, 2, 3, 4 or 5 wherein selected vertically extending horizontally spaced areas of the walls are outwardly spatially offset with respect to the adjacent areas to provide expansion ribs to assist in substantially eliminating the "doming" of foodstufs during the freezing process.

7. An article defined in any one of claims 1, 2, 3, 4 or 5, wherein an outwardly projecting detent is provided at the corners of the container below the upper margins of the walls to facilitate the separation of such articles when empty and nested.

8. An article defined in claim 6, wherein the upper marginal area extending along the side walls and end walls is otuwardly spatially offset defining a horizontal expansion rib to assist in substantially eliminating the "doming" of foodstuffs during the freezing process.

9. An article defined in claim 8, wherein expansion ribs depend downwardly from said horizontal rib.

10. An article defined in claim 9 wherein said ribs extend downwardly into the areas of the side walls defining said pockets.

11. An article defined in claim 10, wherein said one end wall is provided with two of said downwardly extending ribs.

12. An article defined in claim 10, wherein said article contains a foodstuff prepared for consumption.

13. An article defined in claim 6, wherein said article contains a foodstuff prepared for consumption.

14. An article defined in claim 6, wherein an outwardly projecting detent is provided at the corners of the container below and the upper margins of the walls to facilitate the separation of such articles when empty and nested.

15. An article defined in claim 1, wherein the plastic is high density polyethylene.

16. An article defined in claim 6, wherein the plastic is high density polyethylene.

17. An article defined in claim 7, wherein the plastic is high density polyethylene.

18. An article defined in claim 8, wherein the plastic is high density polyethylene.

19. An article defined in claim 9, wherein the plastic is high density polyethylene.

20. An article defined in claim 10, wherein the plastic is high density polyethylene.

21. An article defined in claim 11, wherein the plastic is high density polyethylene.

22. An article defined in claim 14, wherein the plastic is high density polyethlene.

* * * * *